United States Patent [19]

Yokoyama

[11] 4,383,501

[45] May 17, 1983

[54] COOLING SYSTEM FOR INTERNAL COMBUSTION ENGINE

[75] Inventor: Junichi Yokoyama, Ebina, Japan

[73] Assignee: Nissan Motor Co., Ltd., Yokohama, Japan

[21] Appl. No.: 256,588

[22] Filed: Apr. 22, 1981

[30] Foreign Application Priority Data

May 27, 1980 [JP] Japan ..... 55-72103[U]

[51] Int. Cl.[3] ..... F01P 7/16

[52] U.S. Cl. ..... 123/41.1; 236/34.5

[58] Field of Search ..... 123/41.08, 41.09, 41.1; 236/34.5

[56] References Cited

U.S. PATENT DOCUMENTS

| | | | |
|---|---|---|---|
| 1,346,331 | 7/1920 | Muir | 123/41.1 |
| 2,536,642 | 1/1951 | Holley | 123/41.09 |
| 3,092,322 | 6/1963 | Schwarz | 236/34.5 |
| 4,011,988 | 3/1977 | Inagaki | 123/41.08 X |

FOREIGN PATENT DOCUMENTS 2923523 12/1980 Fed. Rep. of Germany ..... 123/41.1

*Primary Examiner*—William A. Cuchlinski, Jr.
*Attorney, Agent, or Firm*—Lane, Aitken & Kannanen

[57] ABSTRACT

A cooling device for an internal combustion engine includes a communicating passage for communicating the inlet and outlet of a water pump, a cooling water temperature detecting means for detecting the temperature of cooling water for the engine and a valve controlled by the cooling water temperature detecting means for opening the communicating passage when the cooling water temperature is lower than a predetermined value and closing the passage when the temperature is higher than the value, so that when the engine is at a lower temperature the cooling water is not circulated through a cylinder block and a cylinder head of the engine, thereby rapidly raising the temperature of the engine to remarkably improve the exhaust gas characteristics and running performance and reduce the fuel consumption.

6 Claims, 7 Drawing Figures

COOLING SYSTEM FOR INTERNAL COMBUSTION ENGINE

BACKGROUND OF THE INVENTION

1. Field of the Invention

The present invention relates to a cooling system for an internal combustion engine for the purpose of reducing its fuel consumption and improving its exhaust gas characteristics and running performance.

2. Description of the Prior Art

Cooling systems of this kind have been known, for example, as shown in FIG. 1. With such a cooling system, when engine cooling water temperature is lower than a predetermined value, a thermostat 1 closes a passage to a radiator 5, so that water delivered from a water pump 2 flows through a cylinder block 3 and a cylinder head 4 and then returns to an inlet 7 of the water pump 2 through a bypath 6 as shown by arrows in FIG. 1 without entering the radiator 5. In other words in more detail referring to FIG. 2 which is an enlarged partial sectional view, the cooling water from the cylinder head 4 flows through the bypath 6 into the inlet 7 of the water pump and is then forced through an outlet 8 of the pump into an inlet 9 of a water jacket.

With such a conventional cooling device, however, the water is forcedly circulated through an engine by the operative water pump 2 even if the engine cooling water temperature is still low, so that the heat generated from the engine is unduly dissipated by the circulation of the water to delay the rising of the engine temperature. Such a delay of the rising of the engine temperature may adversely affect the fuel consumption, exhaust gas characteristics and running performance of the engine.

SUMMARY OF THE INVENTION

It is a primary object of the invention to provide an improved cooling system for an internal combustion engine, which eliminates the above disadvantages of the prior art.

It is a further object of the invention to provide a cooling system for an internal combustion engine, which at least communicates an inlet and an outlet of a water pump when the temperature of engine cooling water is lower than a predetermined value to prevent the cooling water from entering into a cylinder block and a cylinder head of the engine, thereby rapidly raising the temperature of the engine to an appropriate one.

In order that the invention may be more clearly understood, preferred embodiments will be described, by way of example, with reference to the accompanying drawings.

DETAILED DESCRIPTION OF THE PREFERRED EMBODIMENT

Figure 1:
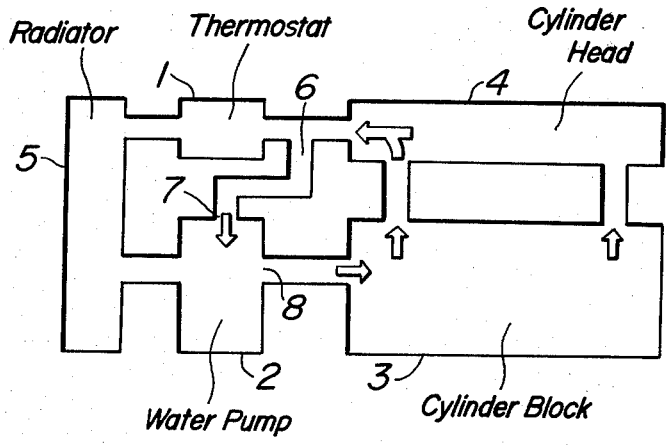
FIG. 1 PRIOR ART
FIG. 1 is a system diagram showing flows of cooling water of the cooling system of the prior art as mentioned above.
Figure 2:
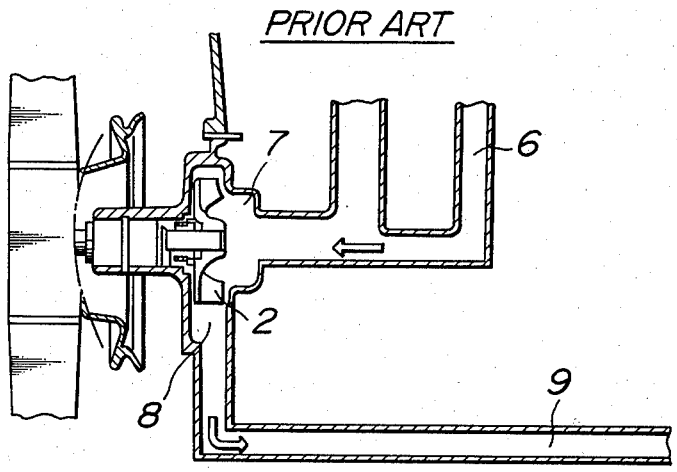
FIG. 2 PRIOR ART
FIG. 2 is an enlarged partial sectional view of the cooling system shown in FIG. 1 as mentioned above.
Figure 3:
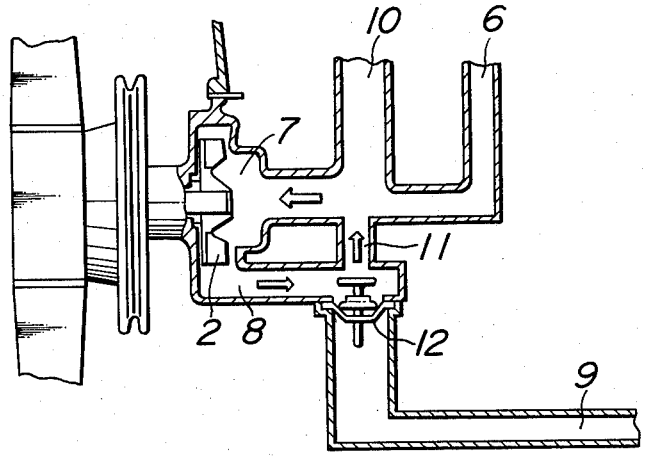
FIG. 3 is a sectional view of a main part of one embodiment of the invention.

Referring to FIG. 3 which is an enlarged sectional view of a main portion of one embodiment of the invention, wherein the same reference numerals as those in FIG. 2 have been utilized to identify like parts, a system according to the invention comprises an outlet passage 10 of a radiator, a communicating passage 11 for communicating an outlet 8 and an inlet 7 of a water pump with each other and a thermostat 12 closing and opening an inlet 9 of a water jacket for the passage 11 depending upon the cooling water temperature.

Figure 4:
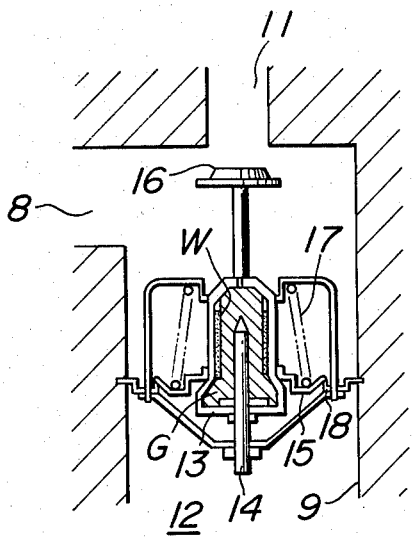
FIGS. 4 and 5 are sectional views of the main part of the cooling system shown in FIG. 3 illustrating its construction and operation conditions.
Figure 5:
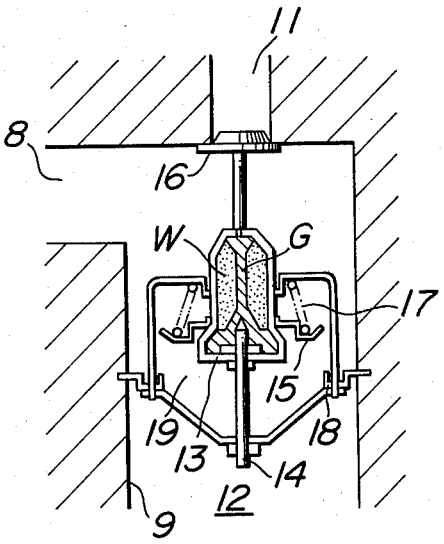

FIGS. 4 and 5 illustrate the detailed construction and operation of the thermostat 12, the former showing the thermostat in inoperative condition when the engine cooling water temperature is relatively low and the latter in operative condition when the water temperature is relatively high.

Referring to FIGS. 4 and 5, a cylinder 13 has a piston 14 and is provided on its inner circumferential surface with wax W and filled therein with synthetic rubber G. The thermostat 12 includes a valve 15 integrally formed with the cylinder 13 and in close contact with a guide 18 at the outer periphery of the valve 15 by an action of a spring 17. A valve 16 closes and opens the communicating passage 11.

The operation of the thermostat is as follows. When the engine cooling temperature is low as shown in FIG. 4, the wax W has shrunk, so that the valve 15 integral with the cylinder 13 is in contact with the guide 18 with the aid of a spring force of the spring 17 and the valve 16 does not close the communicating passage 11 with the result that the cooling water delivered from the outlet 8 of the water pump will be returned to the inlet 7 of the pump through the communicating passage 11. In this manner, the cooling water does not circulate through the cylinder block and cylinder head in cooling the engine, so that the temperature of the engine is rapidly raised to greatly reduce the fuel consumption and improve the exhaust gas characteristics and running performance.

When the engine cooling water temperature has become higher than a predetermined value, the wax W expands and on the contrary the synthetic rubber G shrinks, with the result that the cylinder 13 moves upwardly along the piston 14 and the valve 15 integral with the cylinder 13 also moves upwardly against the spring force of the spring 17 to provide a clearance 19 between the valve 15 and guide 18, through which the cooling water from the outlet 8 of the water pump is introduced into the inlet 9 of the water jacket so as to circulate through the cylinder block and cylinder head. When the engine cooling water temperature has become higher, the valve 16 completely closes the communicating passage 11 so that all the cooling water from the outlet 8 of the water pump is introduced into the inlet 9 of the water jacket.

Figure 6:
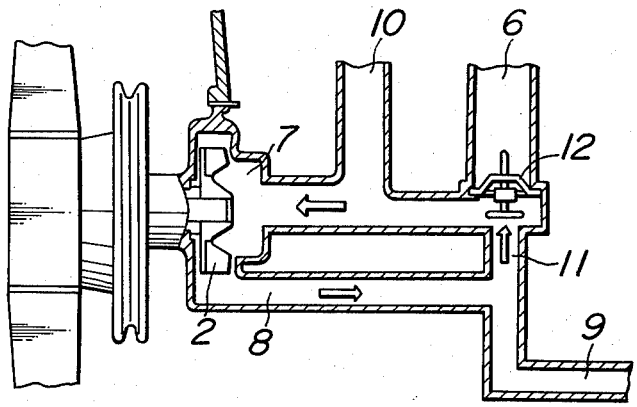
FIG. 6 is a sectional view of a main part of another embodiment of the invention.
Figure 7:
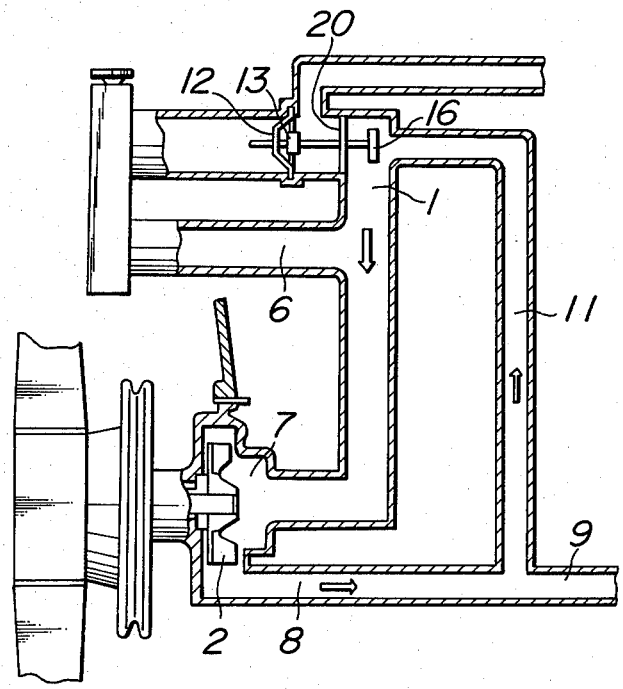
FIG. 7 is a sectional view of a main part of a further embodiment of the invention.

FIGS. 6 and 7 are sectional views of main parts of other embodiments of the system according to the invention. In FIG. 6, a thermostat 12 is provided on a side of a bypath 6, which is similar in operation to that shown in FIG. 3. In FIG. 7, between a cylinder 13 of a thermostat 12 and a valve 16 there is provided a valve 20 for closing and opening a bypath 6, which is similar in operation to those of the above embodiments.

Althrough the above embodiments have been explained to utilize the thermostat 12, the present invention is not limited to this arrangement. The cooling water may be controlled by means of an electromagnetic valve and temperature detecting means which is capable of directly or indirectly detecting the engine cooling water temperature. Furthermore, a thermostat utilizing a bimetal may be used to control the engine cooling water for the same purpose.

Although in the systems of the above embodiments the inlet 9 of the jacket or the bypath 6 is closed at the same time the communicating passage 11 is opened when the engine is at a lower temperature, the present invention is not limited to the feature. A system adapted to close and open only the communicating passage 11 depending upon the cooling water temperature is also contemplated.

As can be seen from the above explanation, the cooling system according to the invention comprises a communicating passage for communicating an inlet and an outlet of a water pump, a cooling water temperature detecting means for detecting the temperature of cooling water, and a valve controlled by the cooling water temperature detecting means for opening the communicating passage when the cooling water temperature is lower than a predetermined value and closing the passage when the temperature is higher than the value, so that when the engine is at a lower temperature the cooling water does not circulate through the cylinder block and cylinder head of the engine, thereby greatly promoting the temperature rise of the engine to remarkably improve the exhaust gas characteristics and running performance and reduce the fuel consumption.

It is further understood by those skilled in the art that the foregoing description discloses preferred embodiments of the invention and that various changes and modifications may be made in the invention without departing from the spirit and scope thereof.

What is claimed is:

1. A cooling system for an internal combustion engine having a cylinder block, a cylinder head, a radiator for cooling water from the cylinder block and the cylinder head, and a pump having an inlet and an outlet comprising:

a bypath in communication with the pump inlet for bypassing the radiator;

a communicating passage directly communicating the pump inlet with the pump outlet;

means for detecting the temperature of the cooling water; and a valve controlled by the detecting means for opening said communicating passage when the temperature of the cooling water is below a predetermined value, whereby the cooling water does not flow through the cylinder block and cylinder head, and for closing said communicating passage when the temperature of the cooling water is higher than said predetermined value, whereby the cooling water flows from the bypath into the cylinder block and the cylinder head.

2. A cooling system as set forth in claim 1, wherein said valve is a thermostat comprising a cylinder having a piston and provided on its inner circumferential surface with wax and filled therein with a synthetic rubber, a valve integrally formed with said cylinder and in close contact with a guide at an outer periphery of the valve by an action of a spring.

3. A cooling system as set forth in claim 2, wherein between said cylinder of the thermostat and said valve there is provided a further valve for closing and opening a bypath for bypassing said cooling water.

4. A cooling system as set forth in claim 1 wherein the valve is provided at an end of the communicating passage communicating with the pump outlet.

5. A cooling system as set forth in claim 1 wherein the valve is provided at an end of the communicating passage communicating with the pump inlet.

6. A cooling system as set forth in claim 1 further including means for controlling the flow of cooling water through the radiator, said flow controlling means preventing flow through the radiator during the operation of said valve so that, when said valve opens said communicating passage, the cooling water flows from the bypath into the cylinder block and the cylinder head.

* * * * *